US007597419B2

(12) United States Patent
Herwald et al.

(10) Patent No.: US 7,597,419 B2
(45) Date of Patent: Oct. 6, 2009

(54) DIRECTIONALLY DEPENDENT CARRIER ISOLATOR FOR AN IMAGING APPARATUS

(75) Inventors: Marc Alan Herwald, Lexington, KY (US); Michael Anthony Marra, III, Lexington, KY (US); Brian Andrew Naro, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/948,346

(22) Filed: Nov. 30, 2007

(65) Prior Publication Data

US 2008/0088667 A1 Apr. 17, 2008

Related U.S. Application Data

(63) Continuation of application No. 10/797,360, filed on Mar. 10, 2004, now Pat. No. 7,364,261.

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS

| | | | |
|---|---|---|---|
| 3,945,022 | A | 3/1976 | Distler |
| 4,573,363 | A | 3/1986 | Shin |
| 4,573,368 | A | 3/1986 | Kobayashi |
| 4,795,285 | A | 1/1989 | Moriya et al. |
| 5,044,797 | A | 9/1991 | Walker et al. |
| 5,151,716 | A | 9/1992 | Kanemitsu |
| 5,366,305 | A | 11/1994 | Christianson |
| 5,465,107 | A | 11/1995 | Mayo et al. |
| 5,595,448 | A | 1/1997 | Harada |
| 5,611,632 | A | 3/1997 | Hiramatsu et al. |
| 5,779,376 | A | 7/1998 | Seu |
| 5,790,150 | A | 8/1998 | Lidke et al. |
| 5,924,809 | A | 7/1999 | Wotton et al. |
| 5,964,542 | A | 10/1999 | Ruhe et al. |
| 5,966,147 | A | 10/1999 | Matsui |
| 6,004,050 | A | 12/1999 | Rehman et al. |
| 6,030,067 | A | 2/2000 | Kawamura |
| 6,158,908 | A | 12/2000 | Yuge |
| 6,244,765 | B1 | 6/2001 | Harriman et al. |
| 6,305,780 | B1 | 10/2001 | Askren et al. |
| 6,310,638 | B1 | 10/2001 | Heiles et al. |
| 6,340,221 | B1 | 1/2002 | Driggers et al. |
| 6,407,380 | B1 | 6/2002 | Sung |
| 6,471,426 | B1 | 10/2002 | Shepherd et al. |
| 6,508,534 | B1 | 1/2003 | Yusef et al. |
| 6,863,390 | B2 | 3/2005 | Arai et al. |
| 2001/0009434 | A1 | 7/2001 | Sasaki |

(Continued)

FOREIGN PATENT DOCUMENTS

| | | | |
|---|---|---|---|
| JP | 04131267 | A | 5/1992 |

*Primary Examiner*—Julian D Huffman
*Assistant Examiner*—Jason S Uhlenhake
(74) *Attorney, Agent, or Firm*—Taylor & Aust PC

(57) ABSTRACT

An interface device for attaching a printhead carrier to a carrier drive belt includes a belt holder attached to the carrier drive belt, and an isolator coupled between the belt holder and the printhead carrier. The isolator is configured to provide directionally dependent filtering of vibrations propagating to the printhead carrier.

11 Claims, 8 Drawing Sheets

U.S. PATENT DOCUMENTS

2002/0153467 A1 10/2002 Allen et al.

2003/0048325 A1 3/2003 Ikeda

2004/0155923 A1 8/2004 Ikeda et al.

DIRECTIONALLY DEPENDENT CARRIER ISOLATOR FOR AN IMAGING APPARATUS

CROSS REFERENCE TO RELATED APPLICATIONS

This is a continuation of U.S. patent application Ser. No. 10/797,360, entitled "DIRECTIONALLY DEPENDENT CARRIER ISOLATOR FOR AN IMAGING APPARATUS", filed Mar. 10, 2004 now U.S. Pat. No. 7,364,261.

BACKGROUND OF THE INVENTION

1. Field of the Invention

The present invention relates to an imaging apparatus, and, more particularly, to a directionally dependent carrier isolator for an imaging apparatus.

2. Description of the Related Art

During ink jet printing, a printhead, mounted in a printhead carrier, is moved across the print medium in a reciprocating manner in a main scan direction by a carrier drive mechanism, which may include a carrier drive belt, pulleys, and a motor. While the printhead is moving in the main scan direction, ink is selectively ejected from the ink jetting nozzles to form a print swath. After completing at least one print swath, the print medium is indexed a selected amount in a sub scan, i.e., paper feed, direction.

When the carrier transports the printhead across the print medium, vibrations are developed in the carrier, which in turn are transmitted to the printhead. These vibrations cause degradation of the image quality by producing a cyclic error that contributes to vertical banding, and is visible to the naked eye. One cause of such printhead vibration is torque ripple developed in the motor used to drive the printhead carrier back and forth across the print medium. The torque ripple sets up vibratory modes in the carrier drive belt, which transfers the vibratory energy to the printhead carrier. In addition, the carrier system has a fixed frequency natural mode which produces a fluctuation in the force driving the printhead carrier, also yielding vertical banding.

Schemes for reducing such registration error have been attempted, for example, by the use of springs. However, springs alone may not provide sufficient damping to adequately absorb or isolate the offending frequency. In addition, damper inserts have been utilized, but these inserts may not provide sufficient damping at the low frequencies associated with carrier drive torque ripple. Also, some of these schemes may not provide sufficient rigidity, thereby affecting carrier drive control system response.

None of the prior systems, however, are designed to account for variations in the vibrations based on the direction of travel of the printhead carrier. For example, in one common carrier drive configuration, the carrier is transported in one direction by a direct pulling of the carrier by the carrier motor pulley, whereas to transport the carrier in the opposite direction, the carrier motor pulley indirectly pulls the carrier via an idler pulley. Thus, the mechanism for transporting the carrier has different drive characteristics depending on the direction of carrier travel, and accordingly, has differing vibration characteristics depending on the direction of carrier travel.

What is needed in the art is a device that provides directionally dependent damping of vibrations in a printhead carrier system, including its drive mechanism.

SUMMARY OF THE INVENTION

The present invention provides directionally dependent damping of vibrations in a printhead carrier system, including its drive mechanism.

The present invention, in one form thereof, relates to an interface device for attaching a printhead carrier to a carrier drive belt. A belt holder is attached to the carrier drive belt. An isolator is coupled between the belt holder and the printhead carrier. The isolator is configured to provide directionally dependent filtering of vibrations propagating to the printhead carrier.

In another form thereof, the present invention is related to a method for attaching a printhead carrier to a carrier drive belt. The method includes the steps of providing a belt holder attached to the carrier drive belt; and coupling an isolator between the belt holder and the printhead carrier, the isolator being configured to provide directionally dependent filtering of vibrations propagating to the printhead carrier.

In still another form thereof, the present invention relates to an imaging apparatus. The imaging apparatus includes a printhead carrier and a carrier drive belt. A belt holder is attached to the carrier drive belt. An isolator is coupled between the belt holder and the printhead carrier. The isolator is configured to provide directionally dependent filtering of vibrations propagating to the printhead carrier.

In still another form thereof, the present invention is directed to an imaging apparatus, including a carrier drive belt, a belt holder attached to the carrier drive belt, and an isolator coupled to the belt holder. A printhead carrier has a receptacle configured for mounting the isolator. The receptacle has a first thrust wall and a second thrust wall that is spaced apart from the first thrust wall along a bi-directional main scan direction of the printhead carrier. The isolator is retained between and in engagement with the first thrust wall and the second thrust wall. A structural geometry of the second thrust wall is different than a structural geometry of the first thrust wall to adjust an amount of dampening in each direction along the bi-directional main scan direction to provide directionally dependent filtering of vibrations propagating to the printhead carrier.

An advantage of the present invention is that vibrations resulting from both a fixed position torque disturbance (i.e., torque ripple) from the carrier motor and a fixed frequency natural mode of the printhead carrier system can both be adequately dampened, even though their respective excitation peaks occur in different directions of carrier travel.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
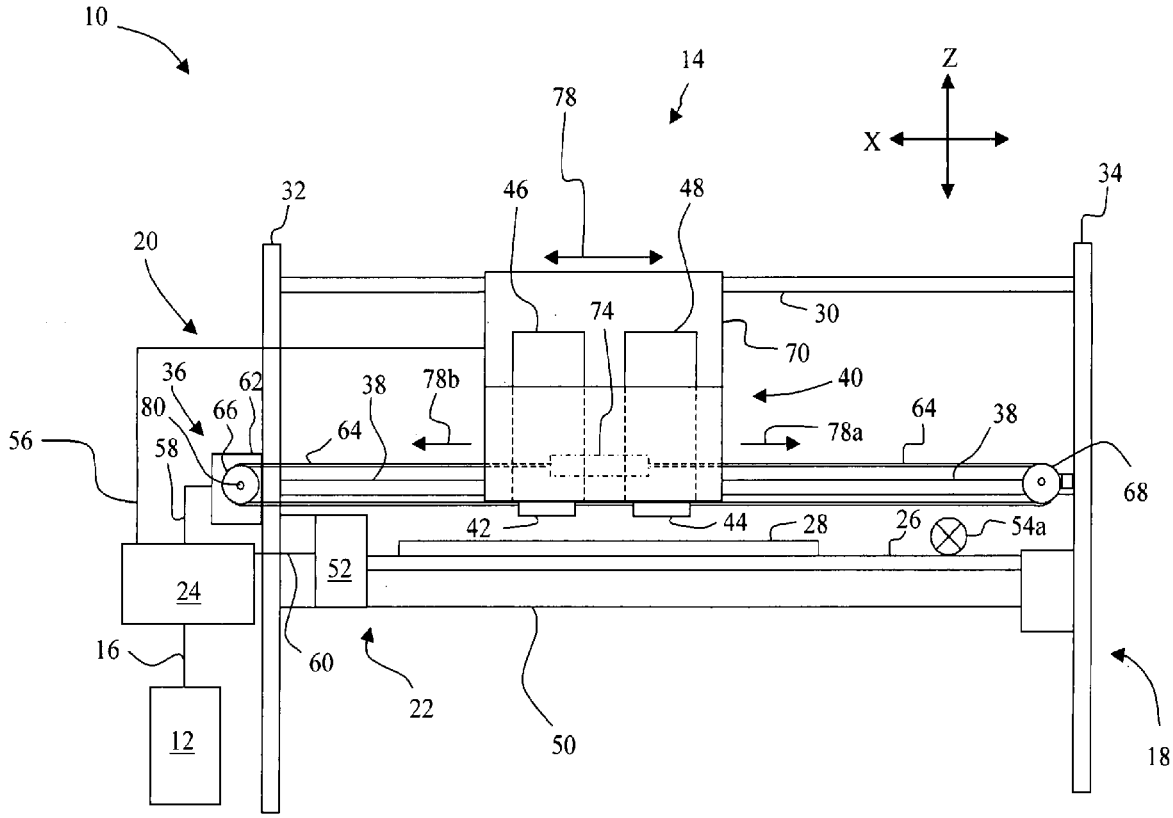
FIG. 1 is a diagrammatic depiction of an imaging system embodying the present invention.

Referring now to the drawings, and particularly to FIG. 1, there is shown a diagrammatic depiction of an imaging system 10 embodying the present invention. Imaging system 10 may include a host 12 and an imaging apparatus 14, or alternatively, imaging system 10 may be a standalone system not attached to a host.

Host 12, which may be optional, may be communicatively coupled to imaging apparatus 14 via a communications link 16. Communications link 16 may be established, for example, by a direct cable connection, wireless connection or by a network connection such as for example an Ethernet local area network (LAN).

In embodiments including host 12, host 12 may be, for example, a personal computer including an input/output (I/O) device, such as keyboard and display monitor. Host 12 further includes a processor, input/output (I/O) interfaces, memory, such as RAM, ROM, NVRAM, and may include a mass data storage device, such as a hard drive, CD-ROM and/or DVD units. During operation, host 12 includes in its memory a software program including program instructions that function as an imaging driver, e.g., printer driver software, for imaging apparatus 14. The imaging driver facilitates communication between host 12 and imaging apparatus 14, and may provide formatted print data to imaging apparatus 14. Alternatively, however, all or a portion of the imaging driver may be incorporated into imaging apparatus 14.

Imaging apparatus 14 may be, for example, a printer or a multifunction unit. Such a printer may be, for example, an ink jet printer having an ink jet print engine. Such a multifunction unit may include an ink jet print engine, and is configured to perform standalone functions, such as copying or facsimile receipt and transmission, or may be connected to host 12 via communications link 16 to facilitate a printing function.

Imaging apparatus 14, in the form of an ink jet printer, includes a frame 18, a printhead carrier system 20, a feed roller unit 22, a controller 24, and a mid-frame 26. Imaging apparatus 14 is configured to form an image, e.g., text and/or graphics, on a print medium 28, such as a sheet of paper, transparency or fabric. In embodiments including host 12, formatted print data may be provided to imaging apparatus 14 via communications link 16.

Frame 18 includes a cross member 30, a side frame 32, and a side frame 34, with mid-frame 26 extending between side frame 32 and side frame 34. Cross member 30 also extends between side frame 32 and side frame 34, and may be formed, for example, by providing a stamped metal plate defining a guide surface.

Printhead carrier system 20 includes a carrier drive system 36, a guide member 38, and a printhead carrier 40 that carries a color printhead 42, and a monochrome (e.g., black) printhead 44, for printing on print medium 28. Guide member 38, which may for example be in the form of a smooth metal rod, is coupled to frame 18 via side frame 32 and side frame 34. Each of cross member 30 and carrier guide member 38 support and guide printhead carrier 40, and are considered part of printhead carrier system 20.

A color ink reservoir 46 is provided in fluid communication with color printhead 42, and a monochrome ink reservoir 48 is provided in fluid communication with monochrome printhead 44. Color ink reservoir 46 and color printhead 42 may be combined to form a unitary color printhead cartridge. Likewise, monochrome ink reservoir 48 and monochrome printhead 44 may be combined to form a unitary monochrome printhead cartridge. Alternatively, color ink reservoir 46 and monochrome ink reservoir 48 may be located remote from printhead carrier 40, and respectively connected to their corresponding printheads 42, 44 via fluid conduits.

Feed roller unit 22 includes a feed roller 50 and corresponding idler pinch rollers (not shown). Feed roller 50 is driven for rotation by a drive unit 52. The pinch rollers apply a biasing force to hold the sheet of print medium 28 in contact with the driven feed roller 50. Drive unit 52 includes a drive source, such as, for example, a direct current (DC) motor, or a stepper motor, and an associated drive mechanism, such as a gear train or belt/pulley arrangement. Feed roller unit 22 feeds print medium 28 in a sheet feed direction 54*a*. As shown in FIG. 1, sheet feed direction 54*a* is depicted as an X within a circle to indicate that the feed direction 54*a* is in a direction perpendicular to the plane of FIG. 1, toward the reader. A direction opposite to sheet feed direction 54*a* will be referred to as direction 54*b*. Under the convention adopted for use in describing the present invention, sheet feed directions 54*a*, 54*b* are parallel to a Y-axis, and thus, sometimes may be referred to as Y-direction 54*a* and/or 54*b*.

Controller 24 is communicatively coupled to color printhead 42 and monochrome printhead 44 via an interface cable 56, such as a flexible ribbon cable. Controller 24 is communicatively coupled to carrier drive system 36 via an interface cable 58. Controller 24 is communicatively coupled to drive unit 52 via an interface cable 60.

Controller 24 includes digital signal processing capability, and may include a processor unit, memory and associated interface circuitry, and may be formed as an Application Specific Integrated Circuit (ASIC). The controller memory may include, for example, random access memory (RAM), read only memory (ROM), and/or non-volatile random access memory (NVRAM). Controller 24 executes program instructions to effect the printing of an image on the sheet of print medium 28, such as coated paper, plain paper, photo paper, or transparency, while the sheet of print medium 28 is supported by mid-frame 26.

Carrier drive system 36 includes a carrier motor 62, a carrier drive belt 64, a carrier drive pulley 66, and an idler pulley 68. Printhead carrier 40 includes a carrier housing 70. A carrier isolator assembly 74 in accordance with the present invention is interposed between carrier drive belt 64 and carrier housing 70, and provides a mechanical interface between carrier drive belt 64 and carrier housing 70.

Printhead carrier 40 is guided by guide member 38 and cross member 30. Printhead carrier 40 is slidably coupled to guide member 38, and is slidably coupled to cross member 30. Guide member 38 defines a bi-directional main scanning direction 78 for printhead carrier 40. Bi-directional main scanning direction 78 is perpendicular to feed direction 54*a*. With reference to the arrangement of components shown in FIG. 1, a left-to-right movement of printhead carrier 40 along bi-directional main scanning direction 78 will be referred to as direction 78*a*, and a right-to-left movement of printhead carrier 40 along bi-directional main scanning direction 78 will be referred to as direction 78*b*. Under the convention used in describing the present invention, bi-directional main scanning direction 78, and specific directions 78*a* and 78*b*, are parallel to an X-axis, and thus, sometimes may be referred to X-direction 78, 78*a* and/or 78*b*.

Carrier drive belt 64 is driven by carrier motor 62 via carrier drive pulley 66, and is supported by an idler pulley 68. Carrier drive belt 64 serves to transmit translation to printhead carrier 40, via carrier isolator assembly 74, in a reciprocating manner along guide member 38 and cross member 30 in bi-directional main scanning direction 78. Carrier motor 62 and idler pulley 68 may be mounted to frame 18. Carrier motor 62 may be, for example, a direct current (DC) motor or a stepper motor, and is coupled to carrier drive pulley 66 via a carrier motor shaft 80.

With reference to the arrangement of components shown in FIG. 1, a clockwise rotation of carrier drive pulley 66 results in an indirect application of force to carrier isolator assembly 74 via carrier drive belt 64 and idler pulley 68, resulting in a left-to-right movement of printhead carrier 40 along bi-directional main scanning direction 78 in direction 78*a*. In contrast, a counter-clockwise rotation of carrier drive pulley 66 results in a direct application of force to carrier isolator assembly 74 via carrier drive belt 64, resulting in a right-to-left movement of printhead carrier 40 along bi-directional main scanning direction 78 in direction 78*b*. Thus, the drive characteristics experienced by printhead carrier 40 via carrier drive system 36 differ depending on the direction of travel of printhead carrier 40, and accordingly, printhead carrier 40 experiences differing vibration characteristics depending on the direction of carrier travel. Such vibrations result in dot placement errors in both the X-direction, i.e., direction 78, and in the Y-direction, i.e., in directions 54*a* and 54*b*, which are perpendicular to the X-direction, and such dot placement errors show up in the printed image formed on print medium 28 in the form of vertical banding.

It has been found that a printhead carrier system, such as printhead carrier system 20 including printhead carrier 40, has two main sources of carrier vibration which induce cyclical dot placement error resulting in vertical banding. One source of carrier vibration resulting in carrier induced dot placement error consists of a fixed position torque disturbance (i.e., torque ripple) from the carrier motor 62 at a frequency, for example, in the range of 3 to 10 cycles per inch (cpi) along the width of the print medium 28. Another source of carrier vibration resulting in carrier induced dot placement error consists of a fixed frequency natural mode of the printhead carrier system 20, at a frequency, for example, of about 50 Hz.

It has been found that printhead carrier 40 is more sensitive to the fixed position torque disturbance for the carrier pull direction that is towards the carrier motor 62, i.e., in direction 78*b*, than in direction 78*a* which is away from carrier motor 62. Pulling printhead carrier 40 towards carrier motor 62 uses a short length of carrier drive belt 64 and would cause increased transmission of carrier motor torque disturbance into printhead carrier 40, in the absence of the present invention. However, when printhead carrier 40 is pulled away from carrier motor 62, i.e., in direction 78*a*, printhead carrier 40 is relatively insensitive to the torque disturbance inputs from carrier motor 62 due to the intervening presence of idler pulley 68. Pulling away from carrier motor 62 uses a long length of carrier drive belt 64 that extends from printhead carrier 40 around idler pulley 68 and then to carrier drive pulley 66 attached to carrier motor 62. Accordingly, in the absence of the present invention, pulling printhead carrier 40 toward carrier motor 62 would result in increased motor torque disturbance inputs into printhead carrier 40, thus causing, for example, increased X-direction dot placement error in main scan direction 78.

Further, it has been found that the opposite situation occurs for the fixed frequency natural mode of printhead carrier system 20. The fixed frequency natural mode of printhead carrier system 20 is excited less for the pull direction towards carrier motor 62, i.e., in direction 78*b*, and is excited more for the pull direction away from carrier motor 62, i.e., in direction 78*a*. Accordingly, in the absence of the present invention, pulling away from carrier motor 62 would allow increased fixed frequency natural mode disturbance inputs into printhead carrier 40 from, for example, the flexible ribbon cable forming interface cable 56, and from carrier drive system 36 via idler pulley 68, thus causing, for example, Y-direction dot placement error at the fixed frequency natural mode of the printhead carrier system 20 in sheet feed direction 54*a* and in opposite direction 54*b*.

Thus, in view of the differences in the vibration characteristics experienced by printhead carrier system 20 as a function of carrier travel direction, resulting from the two above-described sources of carrier vibration induced cyclical dot placement error, it has been found that a symmetrical carrier isolator may not provide acceptable dampening in both of carrier scan directions 78*a* and 78*b*. In accordance with the present invention, carrier isolator assembly 74 is configured to minimize the transmission of the carrier motor fixed position torque disturbance into printhead carrier 40, as well as minimize excitation of the fixed frequency natural mode of printhead carrier system 20, by providing directionally dependent filtering of vibrations propagating to printhead carrier 40, such as for example, via carrier drive belt 64.

Figure 2:
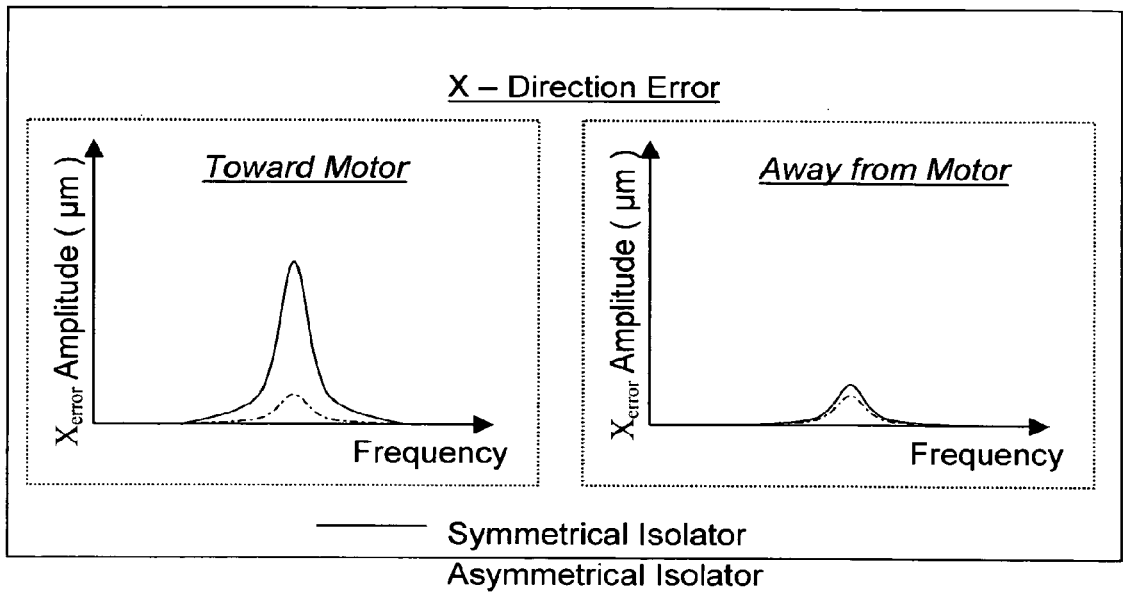
FIG. 2 is a graph showing the vibration dampening characteristics of a carrier isolator assembly of the present invention with respect to dot placement error in the X-direction ($X_{error}$), in comparison to a symmetrical isolator/printhead carrier arrangement.

FIG. 2 shows the vibration dampening characteristics of carrier isolator assembly 74 of the present invention, which may have an asymmetrical configuration, with respect to dot placement error in the X-direction ($X_{error}$), i.e., main scan direction 78, depending on the direction (78*a* or 78*b*) of travel of printhead carrier 40, in comparison to the vibration dampening characteristics of a similar printhead carrier system configuration that uses a symmetrical carrier isolator/printhead carrier. As shown, a significant reduction in the X-direction dot placement error amplitude attributable to the fixed position torque disturbance (i.e., torque ripple) from carrier motor 62 is achieved by using the carrier isolator assembly 74 of the present invention, both in the direction 78*b* toward carrier motor 62 and in the direction 78*a* away from carrier motor 62, but with the most benefit being attained in the direction 78*b* toward carrier motor 62.

Figure 3:
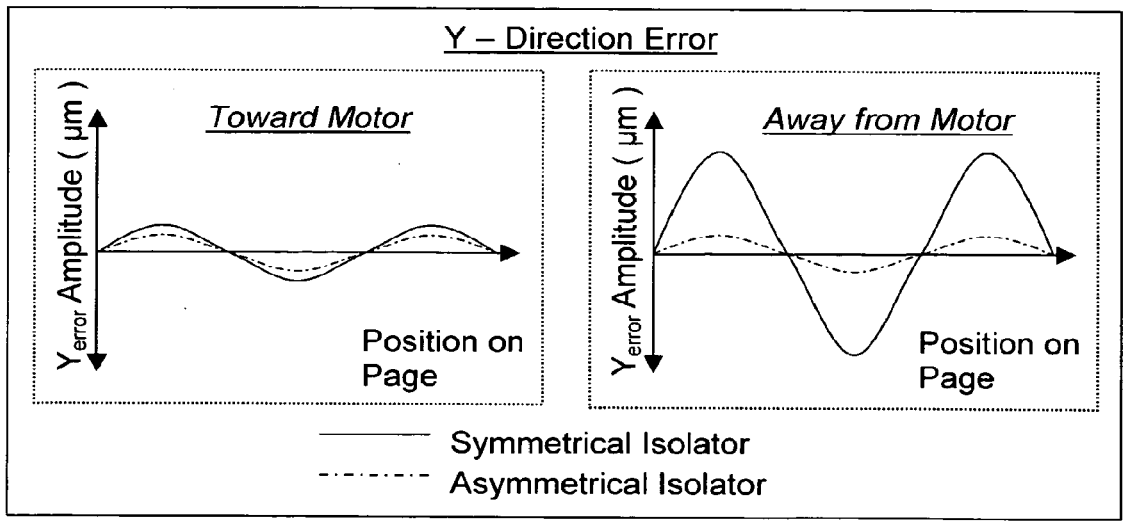
FIG. 3 is a graph that illustrates the vibration dampening characteristics of a carrier isolator assembly of the present invention with respect to dot placement error in the Y-direction ($Y_{error}$), in comparison to a symmetrical isolator/printhead carrier arrangement.

FIG. 3 shows the vibration dampening characteristics of carrier isolator assembly 74 of the present invention, which may have an asymmetrical configuration, with respect to dot placement error in the Y-direction ($Y_{error}$), i.e., in directions 54*a*, 54*b*, depending on the direction (78*a* or 78*b*) of travel of printhead carrier 40, in comparison to the vibration dampening characteristics of a similar printhead carrier system configuration that uses a symmetrical carrier isolator/printhead carrier arrangement. As shown, a significant reduction in the Y-direction dot placement error amplitude attributable to the carrier natural mode frequency of printhead carrier system 20 is achieved by using the carrier isolator assembly 74 of the present invention, both in the direction 78*b* toward carrier motor 62 and in the direction 78*a* away from carrier motor 62, but with the most benefit being attained in the direction 78*a* away from carrier motor 62. The Y-dot placement error attributable to the carrier natural mode frequency is with respect to a position along the width of the page, i.e., a position along the width of the sheet of print medium 28 along main scan direction 78.

In particular, with respect to FIGS. 1-3, for pulling printhead carrier 40 in direction 78*b* toward carrier motor 62, carrier isolator assembly 74 is configured to have a lowered frequency for the low pass filter cutoff point to help filter fixed position torque disturbances generated by carrier motor 62. For pulling printhead carrier 40 in direction 78*a* away from the carrier motor 62, carrier isolator assembly 74 is configured to have the filter cutoff point raised to minimize excitation of the fixed frequency natural mode frequency of printhead carrier system 20. Accordingly, carrier isolator assembly 74 is configured to provide directionally dependent filtering of vibrations induced in printhead carrier 40, such as vibrations propagating through carrier drive belt 64, by providing a first dampening of vibration when printhead carrier 40 is moved in a first direction and providing a second dampening of vibration different from the first dampening of vibration when printhead carrier 40 is moved in a second direction opposite to the first direction.

One embodiment of carrier isolator assembly 74, and the way carrier isolator assembly 74 is coupled to both carrier housing 70 and carrier drive belt 64, will be described below with respect to FIGS. 4A, 4B, 5A and 5B.

Figure 4A:
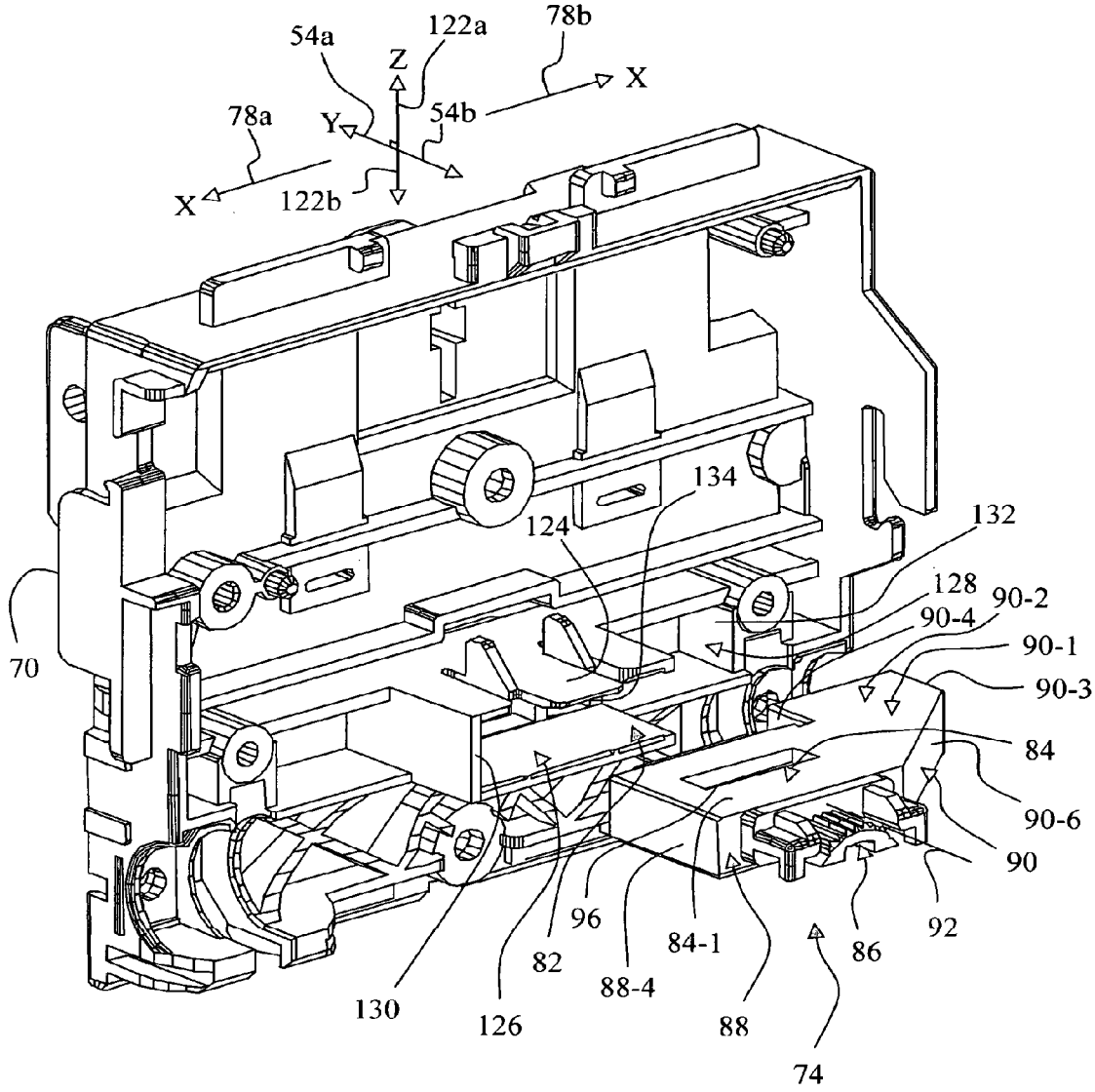
FIG. 4A is an exploded perspective view of a carrier housing and carrier isolator assembly of the present invention to show the receptacle in the carrier housing for receiving and mounting the carrier isolator assembly of the present invention.
Figure 4B:
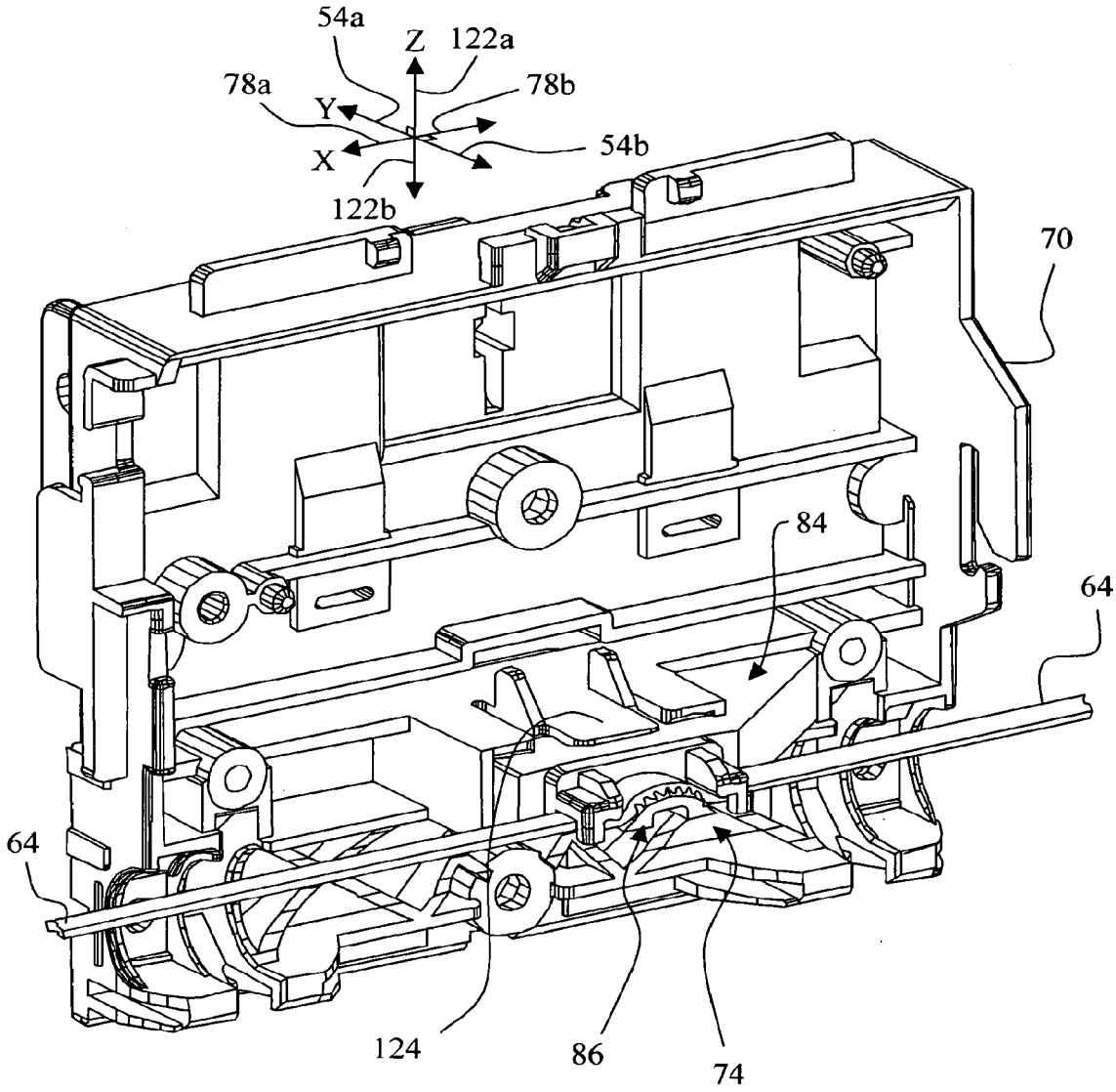
FIG. 4B is a perspective view of the carrier housing and carrier isolator assembly of the present invention with the carrier isolator assembly mounted to the carrier housing.

FIG. 4A shows carrier isolator assembly 74 prior to being mounted to carrier housing 70, and FIG. 4B shows carrier isolator assembly 74 after it is mounted to carrier housing 70 and to carrier drive belt 64. FIGS. 4A and 4B show an opposite side of carrier housing 70 to that depicted in FIG. 1.

As best seen in FIG. 4A, carrier housing 70 includes a receptacle 82 for receiving and mounting carrier isolator assembly 74. Carrier isolator assembly 74 may include an asymmetrical isolator, or isolator boot, 84 and a belt holder 86. Belt holder 86 is held in an interference fit by asymmetrical isolator 84, which will be described in greater detail below with respect to FIGS. 5A and 5B. Belt holder 86 may be formed, for example, from plastic.

Figure 5A:
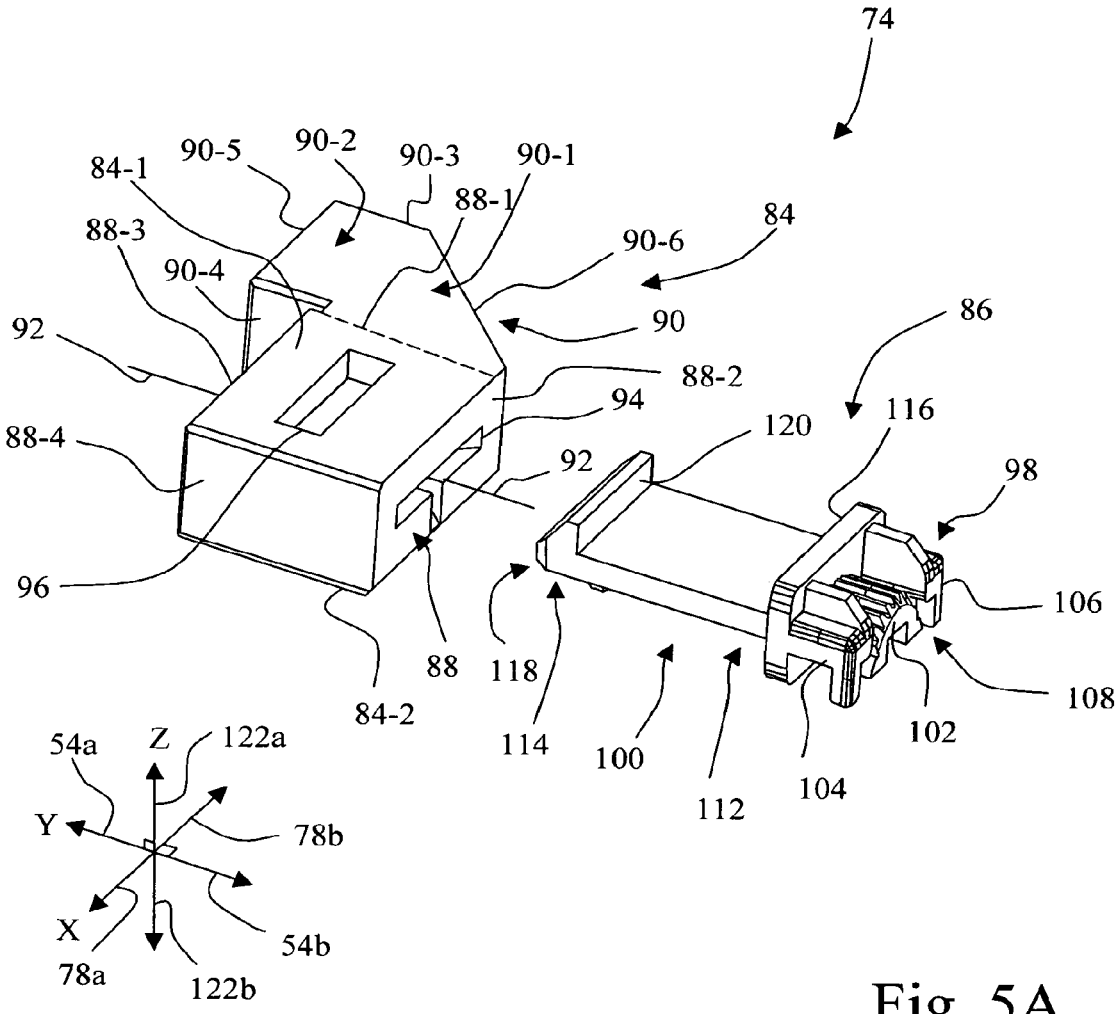
FIG. 5A is an exploded perspective view of the carrier isolator assembly of FIGS. 4A and 4B, which shows details of an asymmetrical isolator and the belt holder, in accordance with the present invention.
Figure 5B:
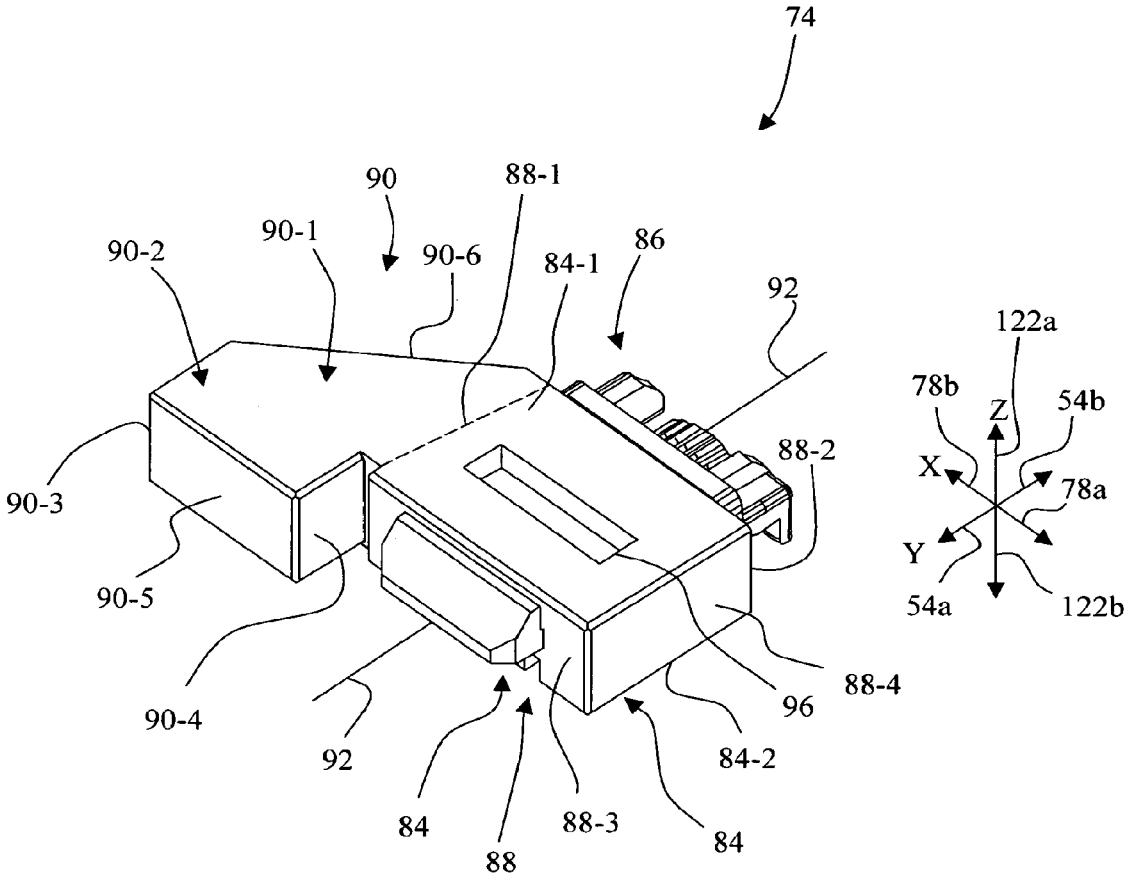
FIG. 5B is a perspective view of the carrier isolator assembly of FIG. 5A, with the asymmetrical isolator and the belt holder being assembled.

Referring to FIGS. 4A, 5A and 5B, asymmetrical isolator 84 is preferably formed as a unitary structure from an elastomeric material. As shown, asymmetrical isolator 84 may have somewhat of an L shape exterior profile.

Asymmetrical isolator 84 includes a top surface 84-1, a bottom surface 84-2, a main body 88, which may be rectangular in shape, and a supplemental dampening body 90 extending from one side 88-1 (imaginary) of main body 88 in direction 78*b*. Main body 88 further includes a front surface 88-2, a rear surface 88-3, and an end surface 88-4 (opposite to imaginary side 88-1). In the embodiment shown, supplemental dampening body 90 is defined by a wing portion 90-1 that includes an extension portion 90-2. Wing portion 90-1 extends outwardly from side 88-1 of main body 88 in direction 78*b*. Extension portion 90-2 of wing portion 90-1 extends beyond main body 88 in direction 54*a*, and is offset from main body 88 in direction 78*b*. Supplemental dampening body 90 further includes an end surface 90-3, a side surface 90-4, a bottom surface 90-5 and a sloped surface 90-6. Thus, asymmetrical isolator 84 has an exterior shape that is asymmetrical with respect to a centerline 92 that bisects main body 88, due to the presence of supplemental dampening body 90, since there is no corresponding body to that of supplemental dampening body 90 on the opposite end surface 88-4 of main body 88, i.e., there is no corresponding body to that of supplemental dampening body 90 on the opposite side of centerline 92.

Main body 88 includes a front surface 88-2, a rear surface 88-3, and end surface 88-4 (opposite to imaginary side 88-1). As shown in FIG. 5A, a horizontally extending slot 94 is formed in and extends through main body 88 along centerline 92 from front surface 88-2 to rear surface 88-3 in direction 54*a*. A latch slot 96 is formed in top surface 84-1, vertically positioned above centerline 92 of main body 88.

Referring to FIGS. 5A and 5B, belt holder 86 is mounted to asymmetrical isolator 84 along the centerline 92 of main body 88 of asymmetrical isolator 84. Belt holder 86 includes a head portion 98 and a shank 100.

Head portion 98 is configured with an arcuate member 102 having a curved tooth profile, which is complementary to the toothed profile of carrier drive belt 64. A pair of spaced projections 104, 106 define a U-shaped passageway 108 between projections 104, 106 and arcuate member 102, and engage the side of carrier drive belt 64 opposite to the side of carrier drive belt 64 that engages the teeth of arcuate member 102, thereby preventing carrier drive belt from slipping along main scan direction 78 (i.e., in either of directions 78*a* or 78*b*).

Shank 100 has a proximal end 112 and a distal end 114. Proximal end 112 is attached, e.g., formed, adjacent to head portion 98 to define an inwardly facing retention surface 116. Distal end 114 is attached to a nose portion 118 (e.g., is formed at distal end 114) having a wedge shape, and defines an inwardly facing retention surface 120. Thus, retention surface 116 is spaced apart from retention surface 120 in directions 54*a*, 54*b*.

The assembly of carrier isolator assembly 74 is as follows. The dimensions of main body 88 of asymmetrical isolator 84 and of belt holder 86 are selected to form an interference fit. Nose portion 118 is inserted into slot 94 of main body 88, and passes through main body 88. At this time, inwardly facing retention surface 116 of belt holder 86 engages front surface 88-2 of main body 88, and inwardly facing retention surface 120 of belt holder 86 engages rear surface 88-3 of main body 88, wherein the elastomeric material of main body 88 is now in a state of slight compression. Likewise, the dimensions of slot 94 formed in main body 88 are selected to form a snug fit around shank 100 of belt holder 86. Thus, the forces exerted by main body 88 of asymmetrical isolator 84 on belt holder 86 restrain movement of belt holder 86 with respect to asymmetrical isolator 84 in all directions, including X-directions 78*a*, 78*b*, Y-directions 54*a*, 54*b*, and Z directions 122*a*, 122*b*.

Under the convention used in describing the present invention, Z directions 122*a*, 122*b* are parallel to a Z-axis, as shown in FIGS. 2-5B.

The mounting of carrier isolator assembly 74 to carrier housing 70 will now be described, with specific reference to FIGS. 4A and 4B. Asymmetrical isolator 84 of carrier isolator assembly 74 is first inserted into receptacle 82 formed in carrier housing 70. Carrier housing 70 further includes a latch 124 that engages latch slot 96 of asymmetrical isolator 84 when asymmetrical isolator 84 is firmly seated in receptacle 82 of carrier housing 70, so as to resist removal of asymmetrical isolator 84 from carrier housing 70 in direction 54*b*. The design of carrier housing 70 and carrier isolator assembly 74 is such that, when assembled, belt holder 86 does not contact carrier housing 70.

More particularly, as shown, receptacle 82 of carrier housing 70 defines a somewhat L-shaped cavity, corresponding generally to the outer shape of asymmetrical isolator 84, and provides an interference fit with asymmetrical isolator 84 when asymmetrical isolator 84 is inserted into receptacle 82. Receptacle 82 includes a first cavity 126 for receiving at least a portion of main body 88 and a second cavity 128 for receiving the extension portion 90-2 of supplemental dampening body 90. First cavity 126 includes a primary thrust wall 130 for engaging an end surface 88-4 of main body 88 of asymmetrical isolator 84. Second cavity 128 includes a primary thrust wall 132 for engaging end surface 90-3 of supplemental dampening body 90 of asymmetrical isolator 84, and has a secondary thrust wall 134 for engaging side surface 90-4 of extension portion 90-2 of supplemental dampening body 90 of asymmetrical isolator 84. Secondary thrust wall 134 is located between primary thrust walls 130, 132 along the X-directions 78*a*, 78*b*.

Alternatively, it is contemplated that receptacle 82 may be designed to accommodate other configurations of a carrier isolator, such as for example, an asymmetrical isolator that does not include extension portion 90-2 of asymmetrical isolator 84.

Accordingly, with the present embodiment of the invention, supplemental dampening body 90 of asymmetrical isolator 84 is positioned from centerline 92, e.g., on the side of belt holder 86, in direction 78*b* toward carrier motor 62, so as to provide a low pass filter having a low pass filter cutoff point that is lower than may be available from a symmetrical isolator, such as an isolator that only includes main body 88, thereby providing a highly desired, if not optimal, vibration dampening when printhead carrier 40 is transported in direction 78*b* toward carrier motor 62, i.e., away from idler pulley 68. Further, the absence of a corresponding wing similar to supplemental damping portion 90 on the side of belt holder 86 in the direction 78*a* away from carrier motor 62, i.e., toward idler pulley 68, provides a low pass filter cutoff point that is higher than may be available from a symmetrical isolator, such as an isolator that includes a dampening body that mirrors supplemental dampening body 90, thereby providing a highly desired, if not optimal, vibration dampening when printhead carrier 40 is transported in direction 78*a* away from carrier motor 62, i.e., toward idler pulley 68. As a result of the invention, drop placement errors in the X-directions 78*a*, 78*b* and Y-directions 54*a*, 54*b* are reduced.

Figure 6:
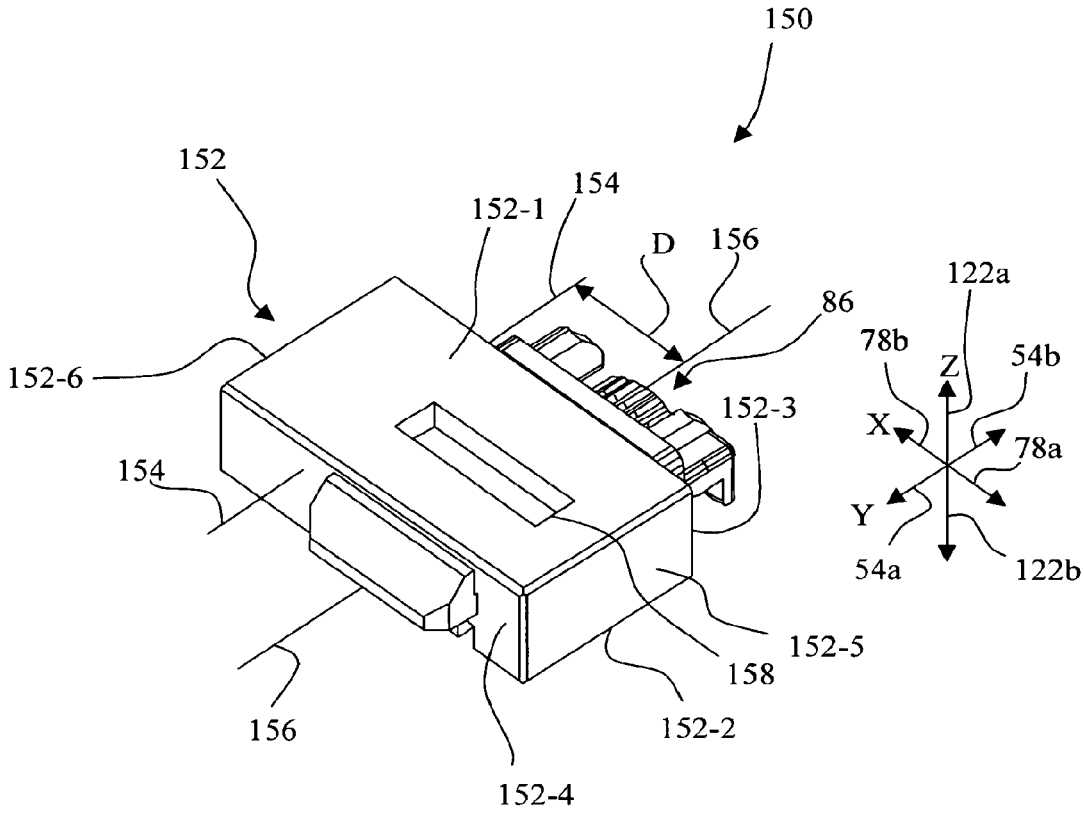
FIG. 6 is a perspective view of another embodiment of a carrier isolator assembly in accordance with the present invention, having an asymmetrical isolator assembled with the belt holder.

FIG. 6 shows another embodiment of a carrier isolator assembly, referenced herein as carrier isolator assembly 150. Carrier isolator assembly 150 includes belt holder 86 and an isolator 152. Of course, the shape and configuration of receptacle 82 of printhead carrier 70 would be modified to receive isolator 152. As shown, isolator 152 may have a rectangular exterior profile, and may be made from an elastomeric material.

Isolator 152 is a body that includes a top surface 152-1, a bottom surface 152-2, a front surface 152-3, a rear surface 152-4, a first end surface 152-5 and a second end surface 152-6. Isolator 152 will be described with respect to a line 154 depicting a center of mass of isolator 152 along X-directions 78*a*, 78*b*. In the embodiment shown, a centerline 156, parallel to line 154, intersects belt holder 86. Belt holder 86 is mounted to the body of isolator 152, wherein the centerline 156 of belt holder 86 is spaced from line 154 depicting the center of mass of the body of isolator 152 by a distance D along a main scan direction 78 of printhead carrier 40, i.e., along X-directions 78*a*, 78*b*.

A latch slot 158 is formed in top surface 152-1. Latch slot 158 is sized and positioned to receive latch 124 of printhead carrier 40, and may be vertically positioned above centerline 156 of belt holder 86.

Accordingly, with the embodiment of FIG. 6 considered in view if FIG. 1, line 154 depicting the center of mass of the body of isolator 152 is offset from centerline 156, e.g., on the side of belt holder 86, in direction 78*b* toward carrier motor 62, so as to provide a low pass filter having a low pass filter cutoff point that is lower than may be available from a symmetrical isolator, thereby providing a highly desired, if not optimal, vibration dampening when printhead carrier 40 is transported in direction 78*b* toward carrier motor 62, i.e., away from idler pulley 68. Further, the absence of a corresponding mass on the side of belt holder 86 in the direction 78*a* away from carrier motor 62, i.e., toward idler pulley 68, provides a low pass filter cutoff point that is higher than may be available from a symmetrical isolator, thereby providing a highly desired, if not optimal, vibration dampening when printhead carrier 40 is transported in direction 78*a* away from carrier motor 62, i.e., toward idler pulley 68. As a result, drop placement errors in the X-directions 78*a*, 78*b* and Y-directions 54*a*, 54*b* are reduced.

It is contemplated that in addition to providing an asymmetrical isolator, such as for example isolators 84 and 152, made of a single material, a carrier isolator may be made to be directionally dependent, or its directionality enhanced, by forming the isolator from multiple materials having different stiffness properties, or from a single material having multiple stiffness properties, exhibited with respect to main scan direction 78. For example, such a carrier isolator may be made using two different elastomers having different stiffness properties during a double shot injection molding process. As another example, a single elastomeric material could be used, and configured to have multiple stiffness properties, such as by adding a different amount of hardener, additives, air bubbles and/or holes in a portion of the carrier isolator in comparison to another portion, e.g., the remainder, of the carrier isolator. Further it is contemplated that such a carrier isolator could be formed using two parts, each part having a different stiffness characteristic. In one exemplary embodiment, such different stiffness properties could be, for example, about 35 durometers and about 55 durometers.

It is further contemplated that in another embodiment, wherein the carrier isolator is made to be directionally dependent based on multiple stiffness properties of the isolator, the isolator could be constructed to have a symmetrical shape, while relying on the multiple stiffness properties of the isolator to provide the asymmetrical isolator effect of providing directionally dependent dampening of vibrations in the printhead carrier system. Such a symmetrical configuration may be similar to, for example, the main body 88/belt holder 86 arrangement of FIGS. 5A and 5B, with the absence of supplemental dampening portion 90.

Figure 7:
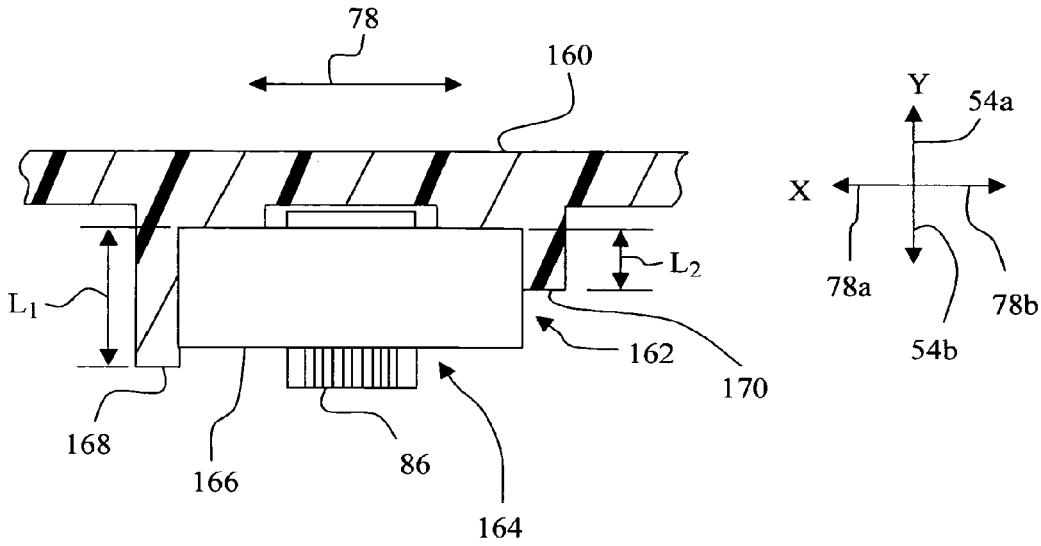
FIG. 7 is a diagrammatic top sectional view of a portion of another carrier housing embodiment of the present invention, corresponding generally to a similar portion of the carrier housing of FIG. 1.

FIG. 7 is a diagrammatic top sectional view of a portion of a carrier housing 160, corresponding generally to a similar portion of carrier housing 70 of FIG. 1. Carrier housing 160 is similar to carrier housing 70 in all respects, with the exception of the receptacle configuration for mounting the carrier isolator assembly, and may be substituted for carrier housing 70 of FIG. 1.

Carrier housing 160 includes a receptacle 162 configured for mounting a carrier isolator assembly 164. Carrier isolator assembly 164 includes an isolator 166 having mounted thereto belt holder 86. Isolator 166 may be formed to be symmetrical in X-directions 78*a*, 78*b*, or alternatively, may be formed to be asymmetrical as, for example, isolator 152 of FIG. 6.

Receptacle 162 has a first thrust wall 168 and a second thrust wall 170 spaced apart from first thrust wall 168 along bi-directional main scan direction 78 of printhead carrier 40. Isolator 166 is retained between and in engagement with first thrust wall 168 and said second thrust wall 170. A structural geometry of second thrust wall 170, such as for example at least one dimension, e.g., length $L_2$, of second thrust wall 170, is different than a structural geometry of first thrust wall 168, such as for example a corresponding dimension, e.g., length $L_1$, of first thrust wall 168, to adjust an amount of dampening in each direction 78*a*, 78*b* along bi-directional main scan direction 78 to provide directionally dependent filtering of vibrations propagating to printhead carrier 40.

For example, by adjusting the length $L_2$ of second thrust wall 170 to be shorter than the length $L_1$ of first thrust wall 168, then the effective stiffness of first thrust wall 168 with respect to isolator 166 will be different from the effective stiffness of second thrust wall 170 with respect to isolator 166.

Referring to FIG. 1 with respect to the arrangement of FIG. 7, second thrust wall 170 is positioned closer to carrier motor 62 than first thrust wall 168. Accordingly, the arrangement of FIG. 7 may provide directionally dependent vibration filtering results similar to that depicted in FIGS. 2 and 3.

Figure 8:
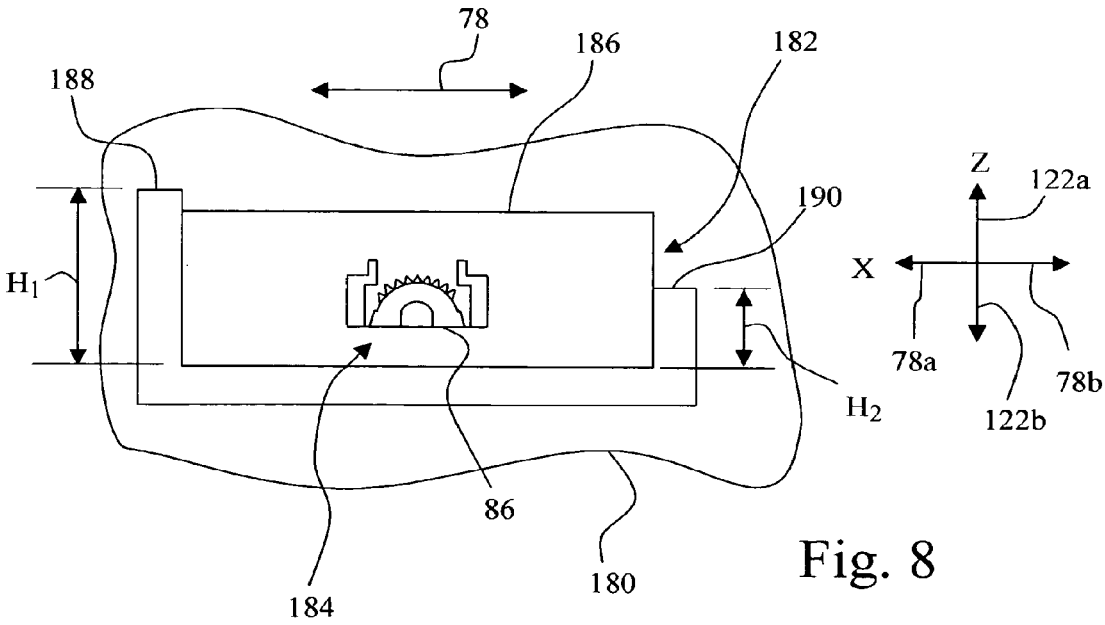
FIG. 8 is a diagrammatic rear view of a portion of still another carrier housing embodiment of the present invention, corresponding generally to a similar portion of the carrier housing of FIG. 1.

FIG. 8 is a diagrammatic rear view of a portion of a carrier housing 180, corresponding generally to a similar portion of carrier housing 70 of FIG. 1. Carrier housing 180 is similar to each of carrier housing 70 and carrier housing 160 in all respects, with the exception of the receptacle configuration for mounting the carrier isolator assembly, and may be substituted for carrier housing 70 of FIG. 1.

Carrier housing 180 includes a receptacle 182 configured for mounting a carrier isolator assembly 184. Carrier isolator assembly 184 includes an isolator 186 having mounted thereto belt holder 86. Isolator 186 may be formed to be symmetrical in X-directions 78*a*, 78*b*, or alternatively, may be formed to be asymmetrical as, for example, isolator 152 of FIG. 6.

Receptacle 182 has a first thrust wall 188 and a second thrust wall 190 spaced apart from first thrust wall 188 along bi-directional main scan direction 78 of printhead carrier 40. Isolator 186 is retained between and in engagement with first thrust wall 188 and said second thrust wall 190. A structural geometry of second thrust wall 190, such as for example at least one dimension, e.g., height $H_2$, of second thrust wall 190, is different than a structural geometry of first thrust wall 188, such as for example a corresponding dimension, e.g., height $H_1$, of first thrust wall 188, to adjust an amount of dampening in each direction 78*a*, 78*b* along bi-directional main scan direction 78 to provide directionally dependent filtering of vibrations propagating to printhead carrier 40.

For example, by adjusting the height $H_2$ of second thrust wall 190 to be shorter than the height $H_1$ of first thrust wall 188, then the effective stiffness of first thrust wall 188 with respect to isolator 186 will be different from the effective stiffness of second thrust wall 190 with respect to isolator 186.

Referring to FIG. 1, with respect to the arrangement of FIG. 8, second thrust wall 190 is positioned closer to carrier motor 62 than first thrust wall 188. Accordingly, the arrangement of FIG. 8 may provide directionally dependent vibration filtering results similar to that depicted in FIGS. 2 and 3.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An interface device for attaching a printhead carrier to a carrier drive belt comprising:

a belt holder attached to said carrier drive belt; and an isolator coupled between said belt holder and said printhead carrier, said isolator being configured to provide directionally dependent filtering along a main scan direction of said printhead carrier of vibrations propagating to said printhead carrier;

wherein said isolator is configured to provide said directionally dependent filtering along said main scan direction such that said isolator provides a first dampening of vibrations propagating in a first direction along said main scan direction and provides a second dampening of vibrations propagating in a second direction along said main scan direction opposite to said first direction, said second dampening being different from said first dampening.

2. The interface device of claim 1, said isolator having a center of mass, and a centerline of said belt holder being spaced from said center of mass of said isolator by a distance along said main scan direction of said printhead carrier.

3. A method for attaching a printhead carrier to a carrier drive belt comprising:

providing a belt holder attached to said carrier drive belt; and coupling an isolator between said belt holder and said printhead carrier, said isolator being configured to provide directionally dependent filtering along a main scan direction of said printhead carrier of vibrations propagating to said printhead carrier;

wherein said isolator is configured to provide said directionally dependent filtering along said main scan direction by providing a first dampening of vibrations propagating in a first direction along said main scan direction and providing a second dampening of vibrations propagating in a second direction along said main scan direction opposite to said first direction, said second dampening being different from said first dampening.

4. The method of claim 3, said isolator having a center of mass, and a centerline of said belt holder being spaced from said center of mass of said isolator by a distance along said main scan direction of said printhead carrier.

5. An imaging apparatus comprising:

a printhead carrier;

a carrier drive belt;

a belt holder attached to said carrier drive belt; and an isolator coupled between said belt holder and said printhead carrier, said isolator being configured to provide directionally dependent filtering along a main scan direction of said printhead carrier of vibrations propagating to said printhead carrier;

wherein said isolator is configured to provide directionally dependent filtering along said main scan line such that said isolator provides a first dampening of vibrations propagating in a first direction along said main scan direction and provides a second dampening of vibrations propagating in a second direction along said main scan direction opposite to said first direction, said second dampening being different from said first dampening.

6. The imaging apparatus of claim 5, said isolator having a center of mass, and a centerline of said belt holder being spaced from said center of mass of said isolator by a distance along said main scan direction of said printhead carrier.

7. An imaging apparatus comprising:

a carrier drive belt;

a belt holder attached to said carrier drive belt;

an isolator coupled to said belt holder; and a printhead carrier having a receptacle configured for mounting said isolator, said receptacle having a first thrust wall and a second thrust wall spaced apart from said first thrust wall along a bi-directional main scan direction of said printhead carrier, said isolator being retained between and in engagement with said first thrust wall and said second thrust wall, wherein a structural geometry of said second thrust wall is different than a structural geometry of said first thrust wall to adjust an amount of dampening in each direction along said bi-directional main scan direction to provide directionally dependent filtering of vibrations propagating to said printhead carrier;

wherein said structural geometry of said first thrust wall and said structural geometry of said second thrust wall are configured to provide a first dampening of vibrations propagating in a first direction along said main scan direction and to provide a second dampening of vibrations propagating in a second direction along said main scan direction opposite to said first direction, said second dampening being different from said first dampening.

8. The imaging apparatus of claim 7, said bi-directional main scan direction including a direction toward a carrier motor and a direction away from said carrier motor, said second thrust wall being positioned closer to said carrier motor than said first thrust wall.

9. The imaging apparatus of claim 7, said second thrust wall being shorter in length than said first thrust wall.

10. The imaging apparatus of claim 7, said second thrust wall being shorter in height than said first thrust wall.

11. The imaging apparatus of claim 7, said isolator being symmetrical.

* * * * *